United States Patent [19]

Landa

[11] 4,268,178

[45] May 19, 1981

[54] ANTI-BOUNCE PROJECTILE COLLECTING SURFACE FOR MICROBALLISTIC PRINTER

[75] Inventor: Benzion Landa, Edmonton, Canada

[73] Assignee: Savin Corporation, Valhalla, N.Y.

[21] Appl. No.: 107,884

[22] Filed: Dec. 28, 1979

[51] Int. Cl.[3] ..... B41J 3/02

[52] U.S. Cl. ..... 400/118; 400/121; 400/686

[58] Field of Search ..... 400/118, 119, 121, 686; 273/355, 356; 51/424, 425; 72/53

[56] References Cited

U.S. PATENT DOCUMENTS 2,766,557 10/1956 Pollard ..... 51/424

3,477,724 11/1969 Wilcox ..... 273/404

3,900,969 8/1975 Diehn ..... 51/424

*Primary Examiner*—Paul T. Sewell

*Attorney, Agent, or Firm*—Shenier & O'Connor

[57] ABSTRACT

My invention relates to a microballistic printer in which I provide a collector wall normally struck by projectiles rebounding from the platen of the printer with an anti-bounce surface. The surface comprises a thin and flexible sheet spaced from the wall to absorb or dissipate the kinetic energy stored in the rebounding projectiles. The sheet has a thickness of the order of four mils and is formed of a material having a ratio of yield strength to modulus of elasticity which is sufficiently high to prevent a permanent set in the area of impact by a projectile.

6 Claims, 3 Drawing Figures

10
12
14
16
18
20
21
22
23
24
25
26
27
28
30
32
33
34
36
38
40
42
44
46
47
48
50
51
52
2
3

ANTI-BOUNCE PROJECTILE COLLECTING SURFACE FOR MICROBALLISTIC PRINTER

BACKGROUND OF THE INVENTION

In my copending application, Ser. No. 39,372, filed May 15, 1979, for "Microballistic Printer", I have shown a high-speed printer in which a plurality of solid projectiles are propelled in free flight across the space from a gun to the medium to be printed and in which the flight paths of the projectiles are so controlled as to produce impacts on the medium in the pattern of the desired printing. The projectiles are cycled in a path from a reservoir, to a gun, to the printing impact surface, then to a collector, from which they are returned to the reservoir.

It is undesirable to have projectiles, which have performed their function by striking a marking ribbon against a receiving medium such as paper on a platen, rebound and bounce around the walls of the collector and possibly strike a projectile on the way to the platen. This will destroy the desired pattern and create undesirable noise. Furthermore, by bouncing back and forth between the walls of the collector, the projectiles are delayed in their return to the reservoir, which will require a larger number of projectiles in the recycling stream.

If a projectile such as a ball drops on a surface which has a high coefficient of restitution, any material, including lead, will bounce from that surface. If the ball itself has a high coefficient of restitution and is dropped on a hard surface having a high coefficient of restitution, the ball will bounce to a very high degree; that is, it will lose very little energy. Stated otherwise, the rebound of a ball is a function of the coefficient of restitution of the materials of both the ball and the surface against which it strikes. If, however, the surface against which the projectile strikes is adapted to dissipate the energy by deforming or converting some of the energy into motion of a mass, the ball will not bounce. I have discovered that, if I take a thin sheet of material and support it by light foam, arranged either as a continuous layer or as discrete pillars or strips, the ball will not bounce from said surface when it strikes it. Apparently, I effectively transfer the kinetic energy from the ball to the thin sheet of resilient material, which deforms or dissipates the energy by flexing. The mechanism is not clearly understood, but a phenomenal result of no-bounce occurs. If I drop a ball on a surface slightly inclined from the horizontal, the ball strikes the surface, does not bounce, and rolls along the surface. If I make the angle horizontal, the ball strikes and stops dead. The ball or projectile may be approximately 0.8 millimeter or 32 mils in diameter and formed of steel. The sheet materials I have used were about one-tenth of a millimeter or four mils in thickness. Lesser thicknesses such as 0.05 millimeter or two mils may be used; however, the sheets of material are more fragile, more difficult to handle, and subject to crinkling. Greater thicknesses such as 0.2 millimeter or eight mils may be used; however, the tendency to rebound is somewhat increased. Sheets of 0.5 millimeter or 20 mils thickness are unsatisfactory for excessive rebound.

FIELD OF THE INVENTION

My invention relates to the provision of an anti-bounce projectile collecting surface, for use in a microballistic printer, for stabilizing the projectiles after they have made impact with the platen.

SUMMARY OF THE INVENTION

In general, my invention contemplates the provision of an energy-absorbing surface which prevents projectiles from bouncing, after they have struck the surface, to stabilize the collection of the projectiles and prevent them from bouncing back and forth between the walls of the collector.

OBJECTS OF THE INVENTION

One object of my invention is to provide a microballistic printer with an anti-bounce collecting surface from which the projectiles are recycled to the reservoir of the gun for reuse.

Another object of my invention is to provide an anti-bounce collecting surface which transfers the kinetic energy of a projectile and dissipates the same to prevent the projectile from bouncing.

Still another object of my invention is to provide a thin, flexible surface adapted to dissipate the energy of a projectile upon its impact with the surface and thus prevent the projectile from bouncing.

DESCRIPTION OF THE PREFERRED EMBODIMENT

Figures 1, 2, 3:
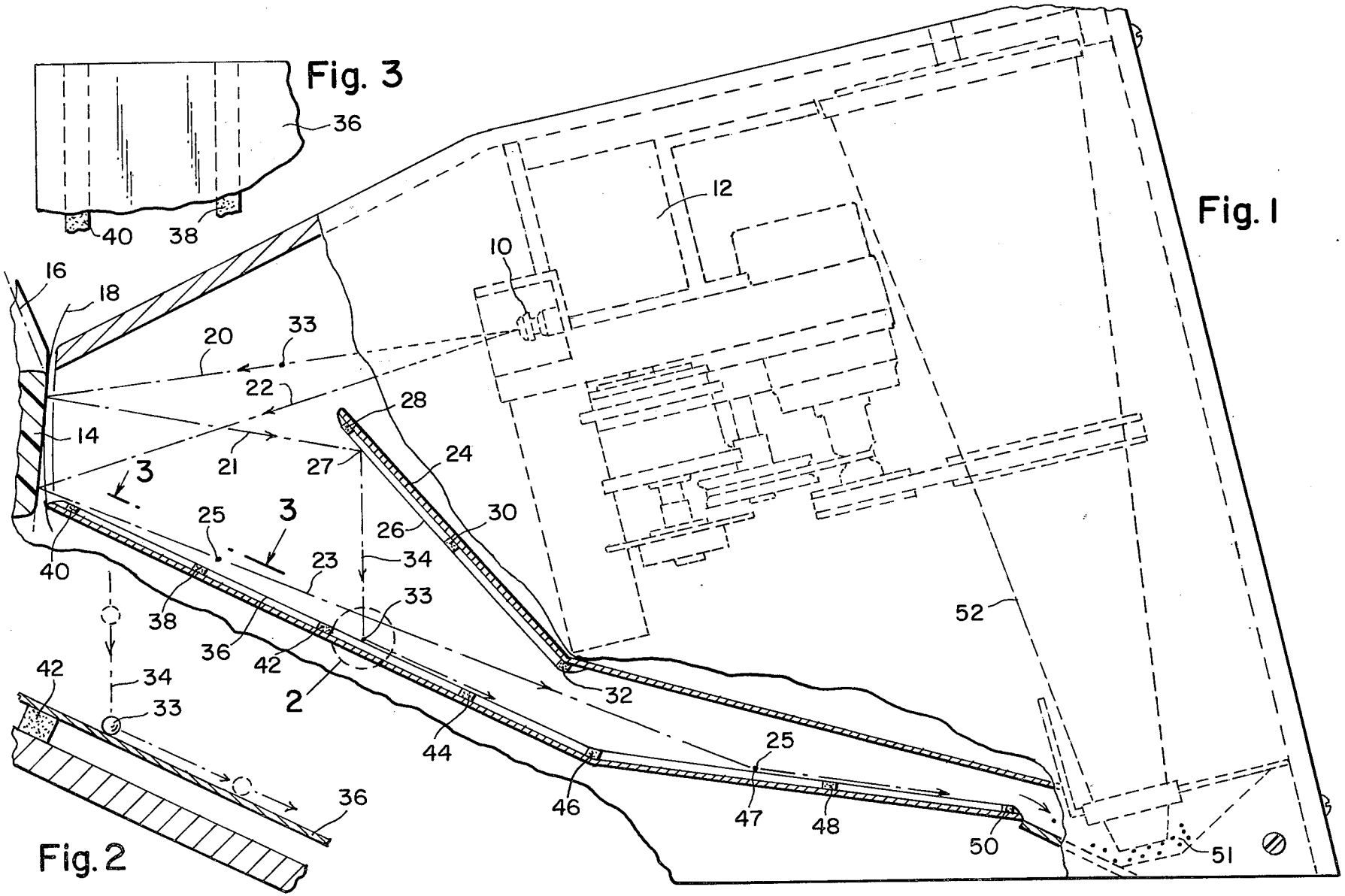
FIG. 1 is a diagrammatic view of a microballistic printer, showing paths of projectiles from a gun to an impact surface and then to the walls of a collector, which walls have been provided with a thin, flexible material according to my invention.
FIG. 2 is a fragmentary view, drawn on a large scale, of a portion of FIG. 1, indicated by the reference numeral 2.
FIG. 3 is a fragmentary view, drawn on a large scale, taken along the line 3—3 of FIG. 1.

Referring now to the drawings, the microballistic printer described in my copending application, above identified, is provided with a gun 10 which is adapted to feed projectiles from a reservoir 12 for projection along paths to produce the desired printing. The projectiles are adapted to strike a platen 14 against which a paper 16 is fed in timed relation. A marking ribbon 18 marks the paper when struck by a projectile from the gun 10. The path indicated by broken line 20 shows the path from the gun to the platen, while broken line 21 shows the rebound path. The path shown by broken line 22 shows another projectile path to the platen, while path 23 shows a rebound path from the platen.

It will be observed that path 21 would strike surface 24 of a collector plate, were it not for a thin sheet 26 spaced from the surface 24 by light synthetic-resin foam strips 28, 30, and 32. The sheet 26 is about one-tenth of a millimeter thick. A projectile 33 along path 21 is shown as striking the sheet 26 at point 27. The projectiles will drop by gravity along path 34, shown more distinctly in FIG. 2, and roll along sheet 36, similar to sheet 26, which is likewise formed of a thin sheet of material supported by light synthetic-resin foam strips 38, 40, 42, 44, 46, 48, and 50. It will be observed that, after the projectile 33 strikes the sheet 36, it will roll without bouncing. Another projectile 25, moving along the path 23, will strike the surface at point 47 and again simply roll along the surface without bouncing. The projectiles collecting in sump 51 are elevated by conical elevator 52 and recycled to the reservoir 12 for reuse.

As indicated above, the sheets must be thin to flex freely but not so thin as to be excessively fragile. The material of which the sheets are formed may be a metal or a plastic. All plastics are satisfactory. Most metals are satisfactory, including steel, stainless steel, hard copper, and alloys of aluminum which have been either work-hardened or heat-treated.

Plastics have a relatively low modulus of elasticity; and the bending or flexure in the thin sheets adjacent the point of impact of the ball does not build up sufficient stress to exceed the yield strength. For plastics, the mean radius of curvature of a four mil sheet at the point of impact with a ball having a radius of sixteen mils, may be approximately eighteen mils; and a relatively large area of contact may exist therebetween.

Metals have a relatively high modulus of elasticity; and the bending or flexure in the thin sheets adjacent the point of impact of the ball can build up sufficient stress to exceed the yield strength. Soft copper and soft aluminum or soft aluminum alloys which have not been work-hardened or heat-treated will be left with an indentation upon each ball impact; and the life of the sheet will be limited under this continual battering. Metal sheets normally have a mean radius of curvature at the point of impact which is much larger than the radius of the ball; and only a small area of contact exists therebetween.

It will thus be appreciated that the sheet must be formed of a material for which the ratio of yield strength to modulus of elasticity is sufficiently high to prevent a permanent set or dishing in the area of impact.

While sheet thickness in the range from 0.05 to 0.2 millimeter are satisfactory for use with a ball of 0.8 millimeter diameter, it will be understood that the range of thickness, and especially the upper limit of the range, is dependent upon ball diameter. While I have shown the sheet to be supported by strips or pillars of light foam, it will be understood that a continuous layer of foam may be used.

It will be seen that I have accomplished the objects of my invention. I have provided an anti-bounce collecting surface for a microballistic printer in which the projectiles are quietly and rapidly assembled for recycling to a reservoir for reuse. The provision of an anti-bounce surface prevents the projectiles, which have been employed in forming the desired printing and have rebounded from a platen, from interfering with projectiles on the way to the platen. The anti-bounce surface of my invention prevents the bouncing of projectiles and thus reduces noise, while at the same time preventing interference with the desired printing. Owing to the fact that the projectiles which have been shot from the gun of the microballistic printer are speedily returned to the reservoir without bouncing, a reduced quantity of projectiles need be employed in the microballistic printer of my invention.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a microballistic printer for applying printing material to a medium, a platen for supporting said medium, means for successively propelling solid projectiles in free flight toward said platen from a location spaced therefrom, a collector having a wall normally struck by projectiles rebounding from said platen, and means for recycling said projectiles to said propelling means, the improvement comprising a thin and flexible sheet of material and means mounting said sheet in spaced relationship with said wall of the collector, said sheet having a thickness in the range from approximately two mils to approximately eight mils, and said material having a ratio of yield strength to modulus of elasticity which is sufficiently high to prevent permanent deformation of the sheet in the area of impact by a projectile.

2. In a microballistic printer in which solid projectiles are propelled against a printing medium supported against a platen and the projectiles collected for recycling by a collector, said collector having a wall normally struck by projectiles rebounding from the platen, the improvement comprising a thin and flexible sheet of material and means for supporting said sheet in spaced relationship with said wall of the collector to inhibit bouncing of projectiles therefrom.

3. In a microballistic printer in which solid projectiles rebound from a platen and the projectiles are collected for recycling by a collector, said collector having a wall normally struck by projectiles rebounding from the platen, the improvement comprising a thin and flexible sheet of material and means for supporting said sheet in spaced relationship with said wall of the collector, said sheet having a thickness in the range from approximately two mils to approximately twelve mils.

4. In a microballistic printer in which solid projectiles rebound from a platen and the projectiles are collected for recycling by a collector, said collector having a wall normally struck by projectiles rebounding from the platen, the improvement comprising a thin and flexible sheet of material and means for supporting said sheet in spaced relationship with said wall of the collector, said sheet having a thickness which is less than sixteen mils.

5. In a microballistic printer in which solid projectiles rebound from a platen and the projectiles are collected for recycling by a collector, said collector having a wall normally struck by projectiles rebounding from the platen, the improvement comprising a thin and flexible sheet of material and means mounting said sheet in spaced relationship with said wall, said sheet having a thickness of the order of magnitude of four mils.

6. In a microballistic printer in which solid projectiles rebound from a platen and the projectiles are collected for recycling by a collector, said collector having a wall normally struck by projectiles rebounding from the platen, the improvement comprising a thin and flexible sheet of material and means mounting said sheet in spaced relationship with said wall of the collector, said material having a ratio of yield strength to modulus of elasticity which is sufficiently high to prevent permanent deformation of the sheet in the area of impact by a projectile.

* * * * *